US005626268A

United States Patent [19]

Kolton et al.

[11] Patent Number: 5,626,268

[45] Date of Patent: May 6, 1997

[54] ENHANCED RETENTION BELT HANGER

[75] Inventors: Chester Kolton, Westfield; Stuart S. Spater, Livingston, both of N.J.

[73] Assignee: B&G Plastics, Inc., Newark, N.J.

[21] Appl. No.: 180,032

[22] Filed: Jan. 11, 1994

[51] Int. Cl.[6] ..... A47G 25/14

[52] U.S. Cl. ..... 223/85; 223/87

[58] Field of Search ..... 223/85, 87; 24/16 PB, 24/622, 700

[56] References Cited

U.S. PATENT DOCUMENTS

| | | | |
|---|---|---|---|
| 3,468,050 | 9/1969 | Pool | 24/16 PB |
| 3,710,996 | 1/1973 | Smilow et al. | 223/87 |
| 4,063,669 | 12/1977 | Smilow et al. | 223/87 |
| 4,453,655 | 6/1984 | Smilow et al. | 223/87 |
| 4,580,319 | 4/1986 | Paradis | 24/16 PB |
| 4,730,615 | 3/1988 | Sutherland et al. | 24/16 PB X |
| 4,875,647 | 10/1989 | Takagi et al. | 24/16 PB |
| 5,079,804 | 1/1992 | Gregurich et al. | 24/16 PB X |
| 5,222,638 | 6/1993 | Kolton et al. | 223/87 |

*Primary Examiner*—Bibhu Mohanty

*Attorney, Agent, or Firm*—Robin, Blecker, Daley & Driscoll

[57] ABSTRACT

A hanger consists of an elongate, one-piece body of plastic material, the hanger having a first portion defining a hook, and a tail portion extending downwardly of the first portion, the hanger having front and rear surfaces, the rear hanger surface being generally planar. The hanger has a given thickness between the front and rear surfaces in the tail portion exceeding the hanger thickness between the front and rear surfaces elsewhere in the tail portion. The tail portion defines a passage therethrough opening into the front and rear hanger surfaces and defines at a free end thereof a projection configured complementally with the passage to be insertable therein and retentively retained outwardly of the hanger rear surface, the projection having a dimension in the direction of the insertion exceeding the given thickness.

9 Claims, 6 Drawing Sheets

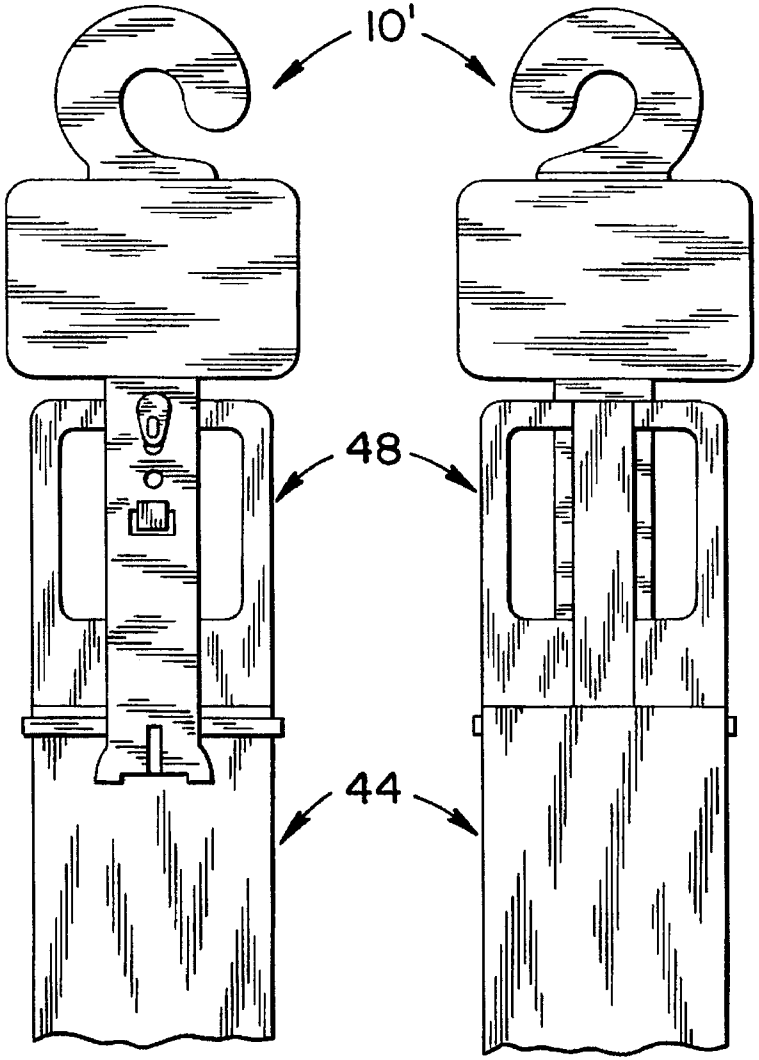
FIG. 9
FIG. 8
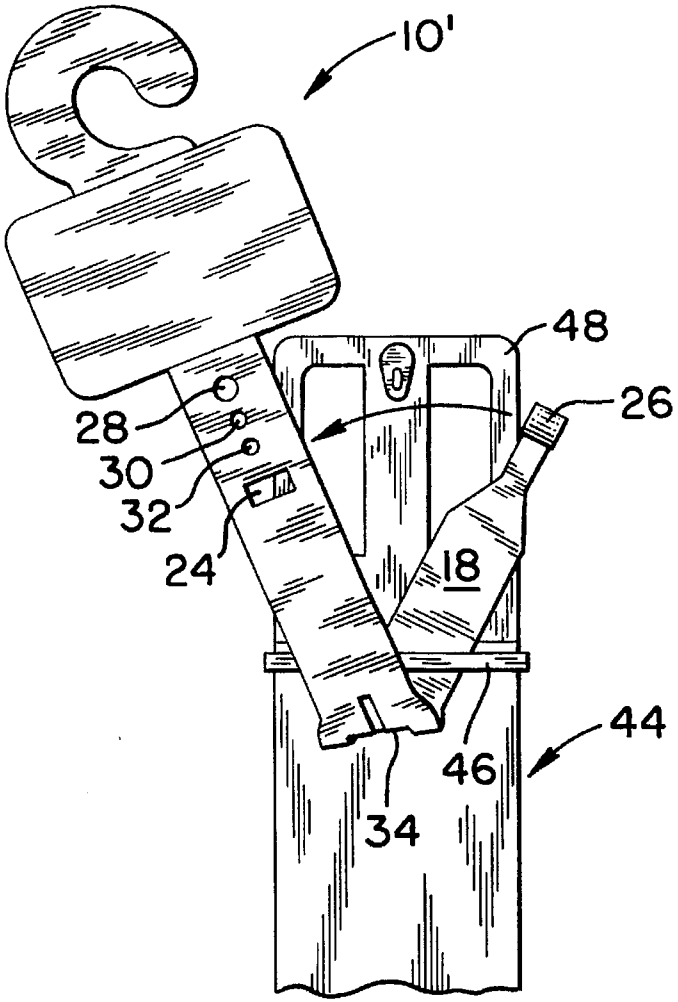
FIG. 7

ENHANCED RETENTION BELT HANGER

FIELD OF THE INVENTION

This invention relates generally to hangers for the display of articles and pertains more particularly to improved hangers for the display of belts.

BACKGROUND OF THE INVENTION

For many years, the belt industry employed a belt hanger of the type employing a flat body of cardboard, and later of plastic, defining an upper hook portion for applying the hanger to a display rod, a central or body portion depending from the hook portion, and a lower or tail portion suspended from the body portion and defining an inverted T-shaped opening.

In use of such hangers, the tail portion was inserted into the frame of a belt buckle and the prong of the buckle was nested in the T-shaped opening, the belt thereby being hung from the display rod, however at an angle to the vertical.

Disadvantage attended such off-vertical belt hanging to the extent that fewer belts could be displayed per lineal dimension of the display rod than would apply were the belt hung in truly vertical manner.

A further disadvantage of such known hangers, later to be referred to as so-called "short tail" or "unfolded tail" hangers, was that the buckle could be readily separated from the hanger. Such separation occurred innocently in the course of a customer applying the belt across his or her waist, but sometimes was fraudulent in instances wherein the hanger included pricing data and the customer desired to shift a hanger for a less expensive belt to a hanger for a more expensive belt.

Solutions to the foregoing problems were presented in the invention disclosed in commonly-assigned U.S. Pat. No. 3,710,996. Therein, a belt hanger structure was disclosed of so-called "folded tail" type, wherein the hook portion continued to suspend therefrom the body portion, but wherein the body portion suspended therefrom a tail portion in the form of a strap defining the inverted T-shaped opening medially thereof, the strap being adapted to be folded about the bottom of the T-shaped opening. The terminal folded part of the tail portion carried a projection and the starting portion of the tail or body portion defined an opening adapted for interference-fit receipt of the projection. Such projection-receiving opening was fully within the hanger in its planar, unfolded state and, with close dimensioning of the opening, the projection, once inserted, could not be released from retention therein by hand. Accordingly, release of the hanger from the belt, innocently or with fraudulent intent, could not be readily realized. Further, since the hanger defined the fold line of the folded tail coincidently with the median thereof, true vertical hanging of hangers and belts secured therein was to be attained, increasing the density of belts which could be hung per unit lineal dimension of the display rod.

In the course of usage of the belt hangers of the '996 patent, belt manufacturers came to look to the latter advantage more than to the former advantage, since the former advantage was fully realized only upon essentially equal insertion and withdrawal forces being involved in use thereof. Thus, belt manufacturers came to witness an assembly labor problem wherein the person applying the hanger to the belt could not readily accomplish the assembly without resort to accessory tooling providing a mechanical advantage. Accordingly, manufacturing comprise was struck as between the insertion and retention forces, giving rise to the continued possibility of fraudulent removal of the hangers from the belts.

By way of further background to the present invention, the belt industry came subsequently to look to the hanging of belts having so-called "stud belt buckles" and a recognition of the problem inherent therein when the short tail hanger was used to hang the same. Here, it was found that the stud, which projected outwardly of the buckle on its underside and was inserted into the T-shaped opening of the short tail hanger, was exposed such that it could mar adjacently hung stud buckles of belts.

In commonly-assigned U.S. Pat. No. 4,063,669, a solution was found for this problem, namely, by disposing the stud of a buckle of a belt to be hung interiorly aside a course of the folded tail of the '996 patent structure. While the structure of the '669 patent provided for retention of the stud in the keyhole opening provided therein, the insertion force involved in retention of the folded tail in locked, folded condition, again as in the case above discussed of the '996 patent, was essentially equal to the insertion force, continuing the comprise as between practical insertion force and practical retention force.

The '996 and '669 patents have been held to be valid in litigation on infringement thereof, as is reported in 691 F. Supp. 741 (SDNY 1988), the Court noting the foregoing advantages in its decision.

The belt hanging industry has come recently to look to an enhanced retention of folded tail hangers with belts hung thereby. Particularly, the extant compromise as between insertion force and retention force has become an unacceptable compromise.

Applicants herein have heretofore met such recent industry need in the belt hanger shown in U.S. Pat. No. 5,005,741. The '741 hanger is comprised of an integral body defining a hook portion for use with a display rod and a further portion adapted to be folded on itself to form a loop, the body being generally planar and existing largely between a front planar surface and a rear planar surface, the further portion having a projection extending forwardly of the front surface, the body defining a cavity at least in part rearwardly of the rear surface for retentive receipt of the projection. In the preferred embodiment, the projection defines a locking member at a free end thereof and a shank intermediate the locking member and the further portion, the locking member exhibiting a maximum cross-sectional dimension for the projection and the shank exhibiting a cross-sectional dimension less than the maximum cross-sectional dimension.

The cavity exhibits a first cross-sectional dimension at the front surface substantially equal to the locking member maximum cross-sectional dimension and a second cross-sectional dimension substantially equal to the shank cross-sectional dimension rearwardly of the rear surface. The cavity is bounded by a tapered interior surface of the body extending from the cavity first diameter to the cavity second diameter.

Insertion force for assembly is accordingly reduced. Concomittantly, however, the disassembly force, i.e., the force overcoming the retention of the assembly, is increased. Thus, as respects the insertion force, in the outset arrangement providing equalization between insertion and disassembly forces, the problem was bottomed in the fact that the opening was fully contained within the planar front and rearward sides of the hanger. This demanded that insertion be attended by the displacement of structure bounding the opening which was fully contained within the hanger planar body. To the contrary, in the '741 hanger, insertion is attended by the circumstance that the displacement of structure bounding the opening is not constrained at all by the otherwise hanger planar body.

SUMMARY OF THE INVENTION

The present invention has as its object the provision of a further hanger having the advantages of that of the '741 patent.

In attaining this and other objects, the invention provides a hanger consisting of an elongate, one-piece body of plastic material, the hanger having a hook portion, a main body portion extending downwardly of the hook portion and a tail portion extending downwardly of the main body portion, the hanger having front and rear surfaces, the rear hanger surface being generally planar.

The hanger has a tail portion part, which is termed herein a "thickened part", i.e., of thickness between the front and rear surfaces in the tail portion exceeding the thickness between the front and rear surfaces elsewhere in the tail portion. Such thickened part defines a passage therethrough opening into the front and rear hanger surfaces. Further, the tail portion defines at a free end thereof a projection configured in part complementally with the passage of the thickened part to be insertable therein and retentively retained outwardly of the hanger rear surface.

As in the case of the '741 patent, the hanger of this invention has insertion force for assembly considerably reduced as contrasted with the force overcoming the retention of the assembly. Again, as respects the insertion force, in the outset arrangement providing equalization between insertion and disassembly forces, the problem was bottomed in the fact that the opening was fully contained within the planar front and rearward sides of the hanger, demanding that insertion be attended by the displacement of structure bounding the opening which was fully contained within the hanger planar body. Whereas, in the '741 hanger, insertion is attended by the circumstance that the displacement of structure bounding the opening outwardly of the rear surface of the hanger is not constrained at all by the otherwise hanger planar body, in the subject invention, applicants provide structure bounding the opening outwardly of the front surface of the hanger for like purpose.

The foregoing and other objects and features of the invention will be further understood from the following detailed discussion of preferred embodiments thereof and from the drawings wherein like reference numerals identify like components and part throughout.

DESCRIPTION OF THE DRAWINGS

FIG. 7 is an explanatory showing for use of the hanger of the invention with a stud buckle type belt.

FIGS. 8 and 9 are respective front and rear elevations of a stud buckle type belt in assembly with the hanger of the invention.

DESCRIPTION OF THE PREFERRED EMBODIMENT AND PRACTICES

Figure 1:
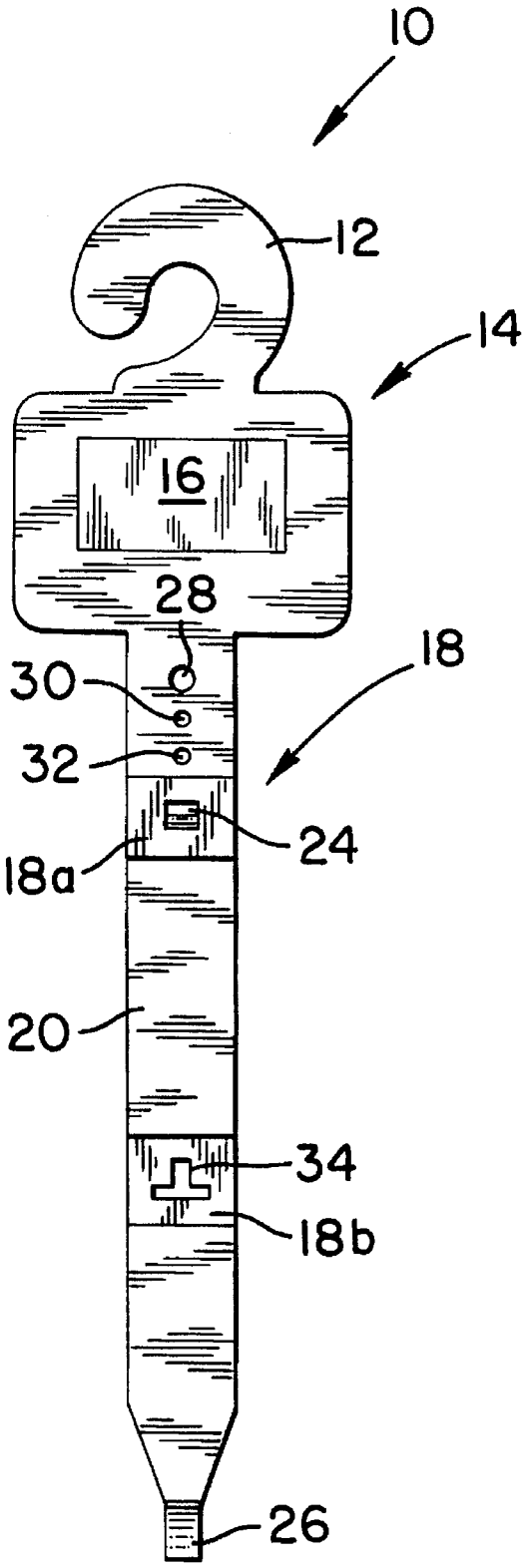
FIG. 1 depicts, in front elevation, a hanger in accordance with the subject invention.
Figure 2:
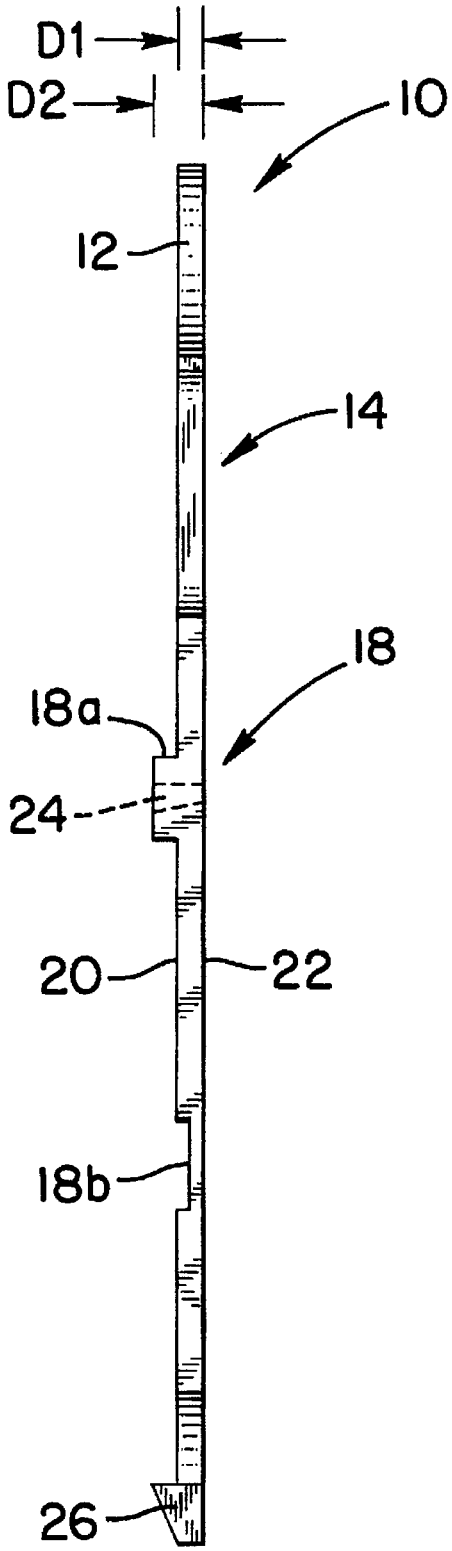
FIG. 2 is a right side elevation of the hanger of FIG. 1.

Referring to FIGS. 1 and 2, hanger 10 consists of an elongate, one-piece body of plastic material, having a hook portion 12, a main body portion 14 having a logo and size display area 16 and a tail portion 18. Hanger 10 has front and rear surfaces 20 and 22, the rear hanger surface being generally planar.

The hanger has a dominant thickness D1 between front and rear surfaces 20 and 22, but, in a thickened part 18*a* of tail portion 18, it has a thickness D2, exceeding thickness D1 generally by two-fold. Tail portion 18 defines a passage 24 extending through thickened part 18*a* and opening into front and rear surfaces 20 and 22.

Tail portion 18 defines at a free end thereof a projection 26 configured in part complementally with passage 24 as discussed in detail below, to be insertable therein and retentively retained outwardly of rear surface 22.

Tail portion 18 has various openings 28, 30 and 32 therein at locations upwardly of thickened part 18*a* for the receipt of studs of stud buckle type belts.

Figure 3:
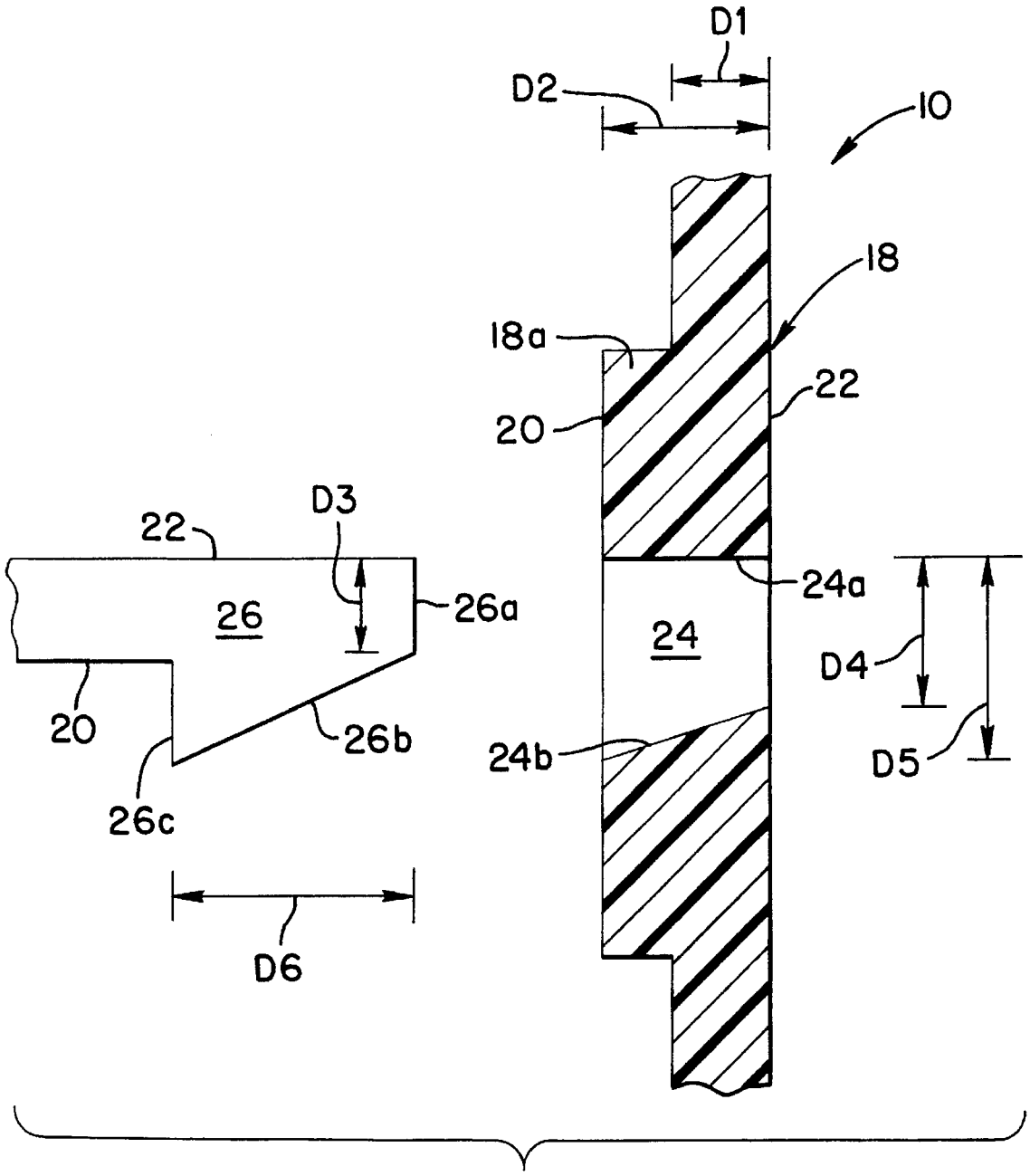
FIG. 3 is an enlarged partial view showing the hanger tail portion thickened part in section centrally of the passage therethrough and the tail portion projection, not in section and separate from the tail portion.

Referring now to FIG. 3, it will be seen that passage 24 is bounded by mutually acutely-angled surfaces 24*a* and 24*b*, the former preferably being horizontal and the latter an an acute angle to the horizontal. As is also seen in FIG. 3, tail portion projection 26 includes rear hanger planar surface 22, a surface 26*a* generally orthogonal to surface 22, an angled surface 26*b* and a surface 26*c*, generally orthogonal to hanger front planar surface 20. Projection 26 will be seen to have dimension D3 in surface 26*a*, which is less than passage entry and exit dimensions D4 and D5, facilitating entry thereof into and through passage 24. Projection 26 also has dimension D6 lengthwise of tail portion 18.

Figure 4:
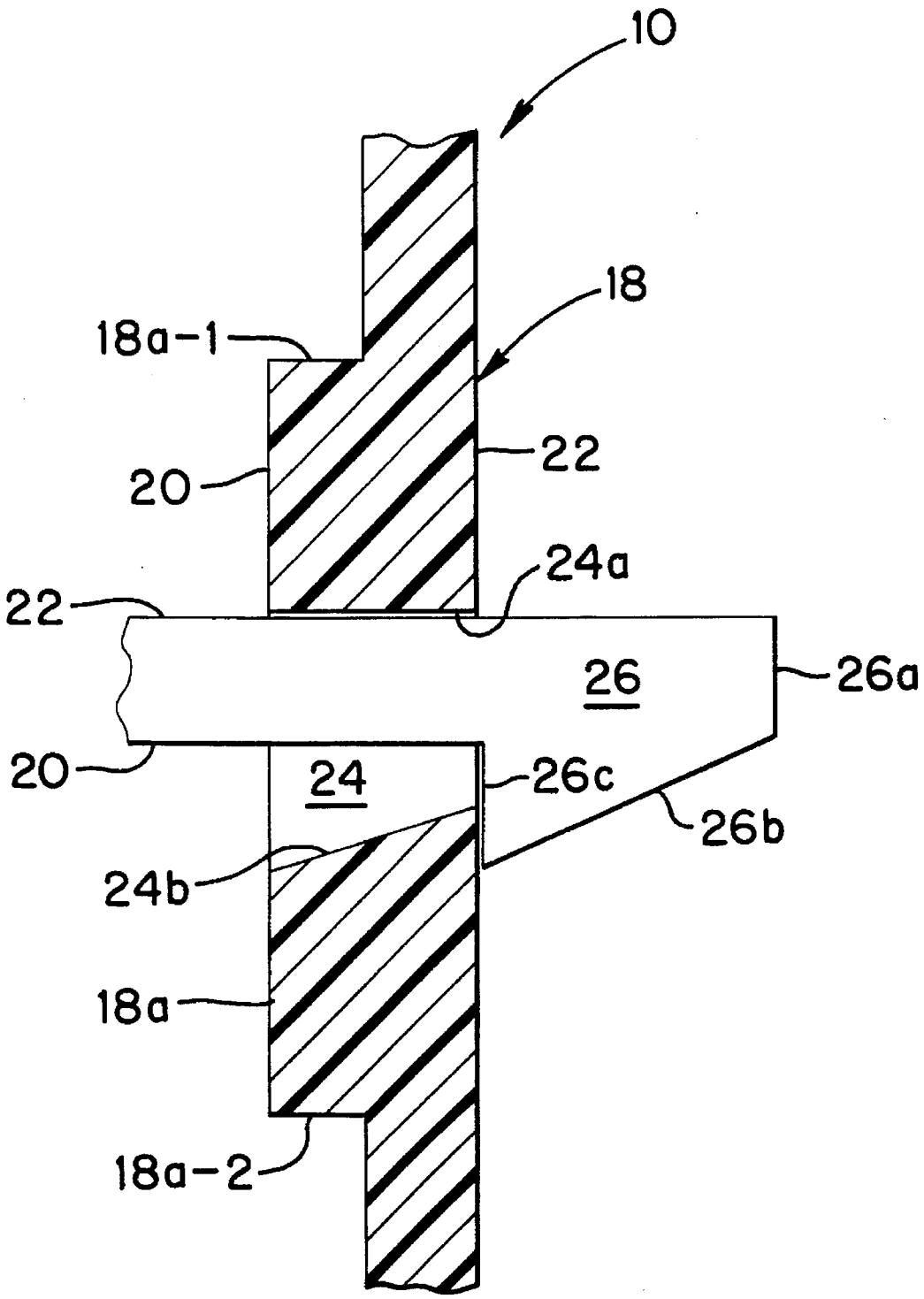
FIG. 4 is a repeat showing of the FIG. 3 components in assembled relation.

In reaching the FIG. 4 assembly, projection 16 is inserted into passage 24 and forced therethrough. In an initial phase of assembly, the complemental configuration of the projection and passage permits ready, friction-free insertion. Thereafter, the remnant of the projection, i.e., that portion thereof outwardly of the passage (of measure D6-D2), is wedged into the passage. In the course of the wedging, thickened part 18*a* expands to facilitate projection entry since it is not bounded by hanger material at its upper and lower limits 18*a*-1 and 18*a*-2.

Figure 5:
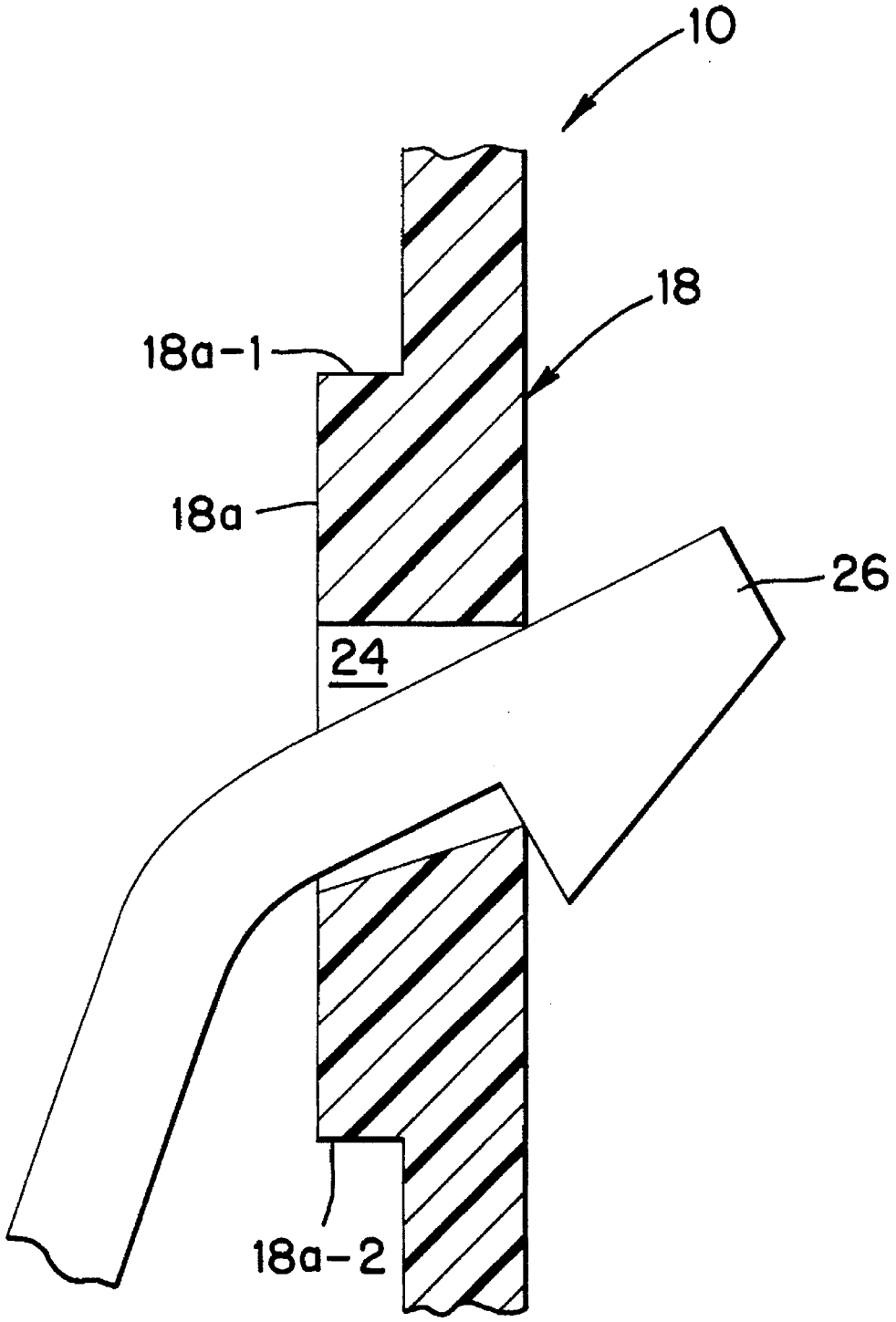
FIG. 5 is a repeat showing of FIG. 4 explaining further the secured retention of the tail portion projection as against manipulative effort to unsecure the assembly.

Once assembly is complete, as is seen in FIG. 5, projection 26 is retentively secured in its locked position as against manipulative withdrawal and cutting of tail portion 18 is required to free the belt from the hanger.

Referring again to FIG. 1, hanger 10 may include also the inverted T opening 34 of commonly-assigned U.S. Pat. No. 3,710,996 in part 18*b* of tail portion 18. Further, portion 18*b* is of lesser thickness than D1 to enhance foldability of the tail portion.

Figure 6:
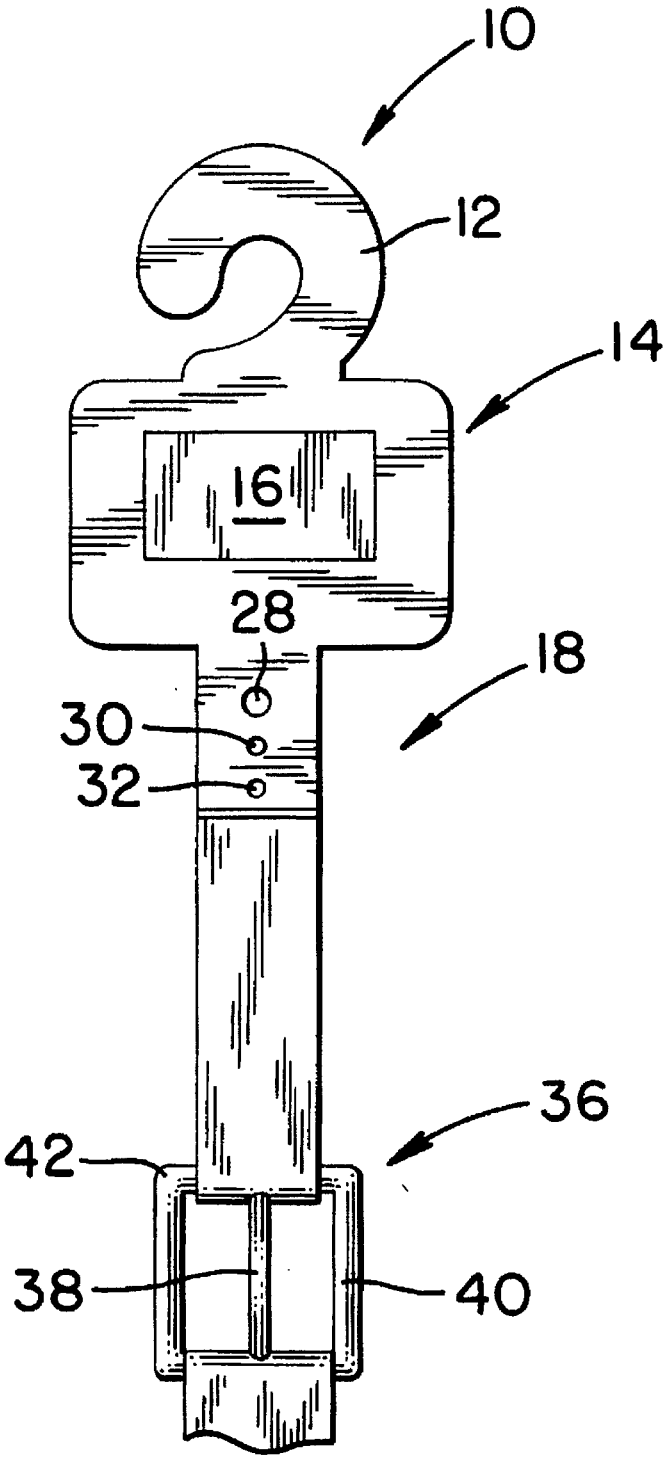
FIG. 6 is a front elevation of a prong-type belt in assembly with the hanger of the invention.

FIG. 6 shows a prong buckle type belt 36 in assembly with hanger 10. Prong 38 of buckle 40 is resident in opening 34 and crossbar 42 of buckle 40 is disposed interiorly of the now folded tail portion 18. In reaching the assembly of FIG. 6, practice is in accordance with the '996 patent, i.e., the free end of tail portion 18 is inserted into the buckle frame to ensnare crossbar 42 and prong is inserted into opening 34. The tail portion is now folded and projection 26 is inserted into passage 24 and wedged therethrough to be retained, as above discussed.

In the case of a stud buckle type belt 44, shown with hanger 10' in FIGS. 7, 8 and 9, the belt receiving portion 46 of the buckle 48 has the free end of tail portion 18 inserted therethrough and the tail portion is folded and its projection 26 inserted into passage 24. The stud is then inserted into the appropriate one of openings 28, 30 or 32 of FIG. 1.

As will be seen, the hanger of the invention is comprised of an integral body defining a hook portion for use with a display rod and a further portion adapted to be folded on itself to form a loop, the integral body having a front planar surface and a rear planar surface, the further portion having a projection extending forwardly of the front planar surface, the integral body having an additional portion extending forwardly of the front planar surface and defining a passage therethrough for receipt of the projection, the passage extending through the additional portion and opening into the hanger rear planar surface.

Various changes to the illustrated embodiment and modifications in practice may evidently be introduced without departing from the invention. Accordingly, it is to be appreciated that the particularly discussed and depicted preferred embodiment and practice of the invention are intended in an illustrative and not in a limiting sense. The true spirit and scope of the invention are set forth in the ensuing claims.

What is claimed is:

1. In a hanger consisting of an elongate, one-piece body of plastic material, said hanger having a main body portion having a front surface for logo display and a tail portion extending downwardly of said main body portion, said tail portion having a first part depending from said main body portion, a second part depending from said first part and defining a passage therethrough and a third, foldable part depending from said second part and defining at a free end thereof a projection configured to be insertable in said passage to retentively retain said foldable part in folded condition, the improvement wherein said tail portion second part has a thickness exceeding the thickness of said tail portion first and third parts and extends forwardly of said main body portion front surface, said tail portion second part defining first and second mutually acutely angled interior surfaces in part bounding said passage.

2. The hanger claimed in claim 1, wherein said hanger further includes a hook portion, said main body portion depending from said hook portion.

3. The hanger claimed in claim 1, wherein said third part of said tail portion defines an opening therethrough, centrally thereof.

4. The hanger claimed in claim 1 wherein said tail portion second part first interior surface is generally orthogonal to said hanger front surface.

5. The hanger claimed in claim 4, wherein said tail portion second part second interior surface is at an acute angle to said hanger front surface.

6. The hanger claimed in claim 5, wherein said tail portion projection has a front surface forming another acute angle with said tail portion.

7. The hanger claimed in claim 6, wherein said acute angle and said other acute angle are substantially equal.

8. The hanger claimed in claim 1 wherein said tail portion projection has a dimension lengthwise of said tail portion in excess of the thickness of said tail portion second part.

9. The hanger claimed in claim 1, wherein said passage has a first opening in said hanger front surface of dimension exceeding a dimension of a second opening of said passage in a rear surface of said hanger.

* * * * *